US005280962A

United States Patent [19]

Wochinski et al.

[11] Patent Number: 5,280,962

[45] Date of Patent: Jan. 25, 1994

[54] SECURE FINANCIAL INSTRUMENT AND METHOD AND APPARATUS FOR PRINTING SAME

[75] Inventors: Ronald F. Wochinski, Palatine; Victor L. Salmons, Waukegan, Both of Ill.

[73] Assignee: The Hedman Company, Chicago, Ill.

[21] Appl. No.: 820,536

[22] Filed: Jan. 14, 1992

[51] Int. Cl.[5] ..... B42D 15/00

[52] U.S. Cl. ..... 283/73; 283/58

[58] Field of Search ..... 283/58, 73

[56] References Cited

U.S. PATENT DOCUMENTS

| | | | |
|---|---|---|---|
| 1,219,634 | 3/1917 | Fisher | 283/58 X |
| 1,372,397 | 3/1921 | Boschen | 283/58 |
| 1,409,706 | 3/1922 | Goosman | 283/58 X |
| 1,431,038 | 10/1922 | Prokopovitsh | 283/058 X |
| 1,465,099 | 8/1923 | Stolberg | 283/73 |
| 3,858,705 | 1/1975 | Reitano | 197/172 |
| 4,455,100 | 6/1984 | Bauer | 283/58 X |
| 4,623,965 | 11/1986 | Wing | 283/58 X |
| 4,662,651 | 5/1987 | Mowry, Jr. | 283/70 |
| 4,667,985 | 5/1987 | Leonard et al. | 283/73 X |
| 4,733,887 | 3/1988 | Mowry, Jr. | 283/58 |

*Primary Examiner*—Paul A. Bell

*Attorney, Agent, or Firm*—Emrich & Dithmar

[57] ABSTRACT

A check protector comprises a print head operating under microprocessor control to print on a medium two separate patterns of characters, each indicating the same amount, preselected by means of a keyboard, and for printing immediately before one of the patterns an intelligible message indicating that the predetermined amount is a maximum amount, thereby to produce a secure financial instrument which is difficult to alter or forge for the purpose of increasing the amount.

4 Claims, 2 Drawing Sheets

SECURE FINANCIAL INSTRUMENT AND METHOD AND APPARATUS FOR PRINTING SAME

BACKGROUND OF THE INVENTION

1. Field Of The Invention

The present invention relates to the protection against alteration of the amount imprinted on a check or other financial instrument.

2. Description Of the Prior Art

Various techniques have been utilized to protect against alteration of the amount imprinted on a financial instrument, such as a check. One popular approach has been to macerate the amount directly into the document. Indelible ink is absorbed by the shredded paper fibers, making it difficult to alter the amount. However, the use of maceration in machines to imprint checks, for example, on a continuous basis undesirably slows down the machine.

Safety papers have been used which have chemically reactive coatings which can change color or bleach out the color and reveal words, such as "VOID", to show that an attempt has been made to alter the document.

Other techniques have involved printing numerical characters against a background or field such as to make attempts to alter the characters readily detectable. Co-pending U.S. application Ser. No. 588,452, filed Sep. 26, 1990, entitled "Check Protector With Means For Printing The Amount In Bands Of Different Colors", prints each character in alternating bands of color to make alteration difficult.

These various types of financial instrument protection require the use of specialized printing equipment and/or paper.

It is also known to provide a standard message on a check that it is not valid over a predetermined amount. This message is typically pre-printed or applied as a standard background, border or prefix during the writing of the check with a mechanical check writer. But the predetermined amount is fixed and does not prevent alterations up to that amount.

SUMMARY OF THE INVENTION

It is a general object of the invention to provide an improved technique for protecting the amount on a financial instrument which avoids the disadvantages of prior techniques while affording additional structural and operating advantages.

An important feature of the invention is the provision of a financial instrument which is safeguarded against an unauthorized increase of the instrument by alteration or forgery.

Another feature of the invention is the provision of a financial instrument of the type set forth which does not require the use of any specialized printing equipment or printing medium.

Yet another feature of the invention is the provision of a method for making a financial instrument of the type set forth.

In connection with the foregoing features, a further feature of the invention is the provision of an apparatus for performing the method of the type set forth.

These and other features of the invention are attained by providing a financial instrument having an amount printed more than once on the face thereof, respectively in separate patterns of characters, one of the patterns being immediately adjacent to an intelligible message indicating that the amount is the maximum amount for which the instrument is valid.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
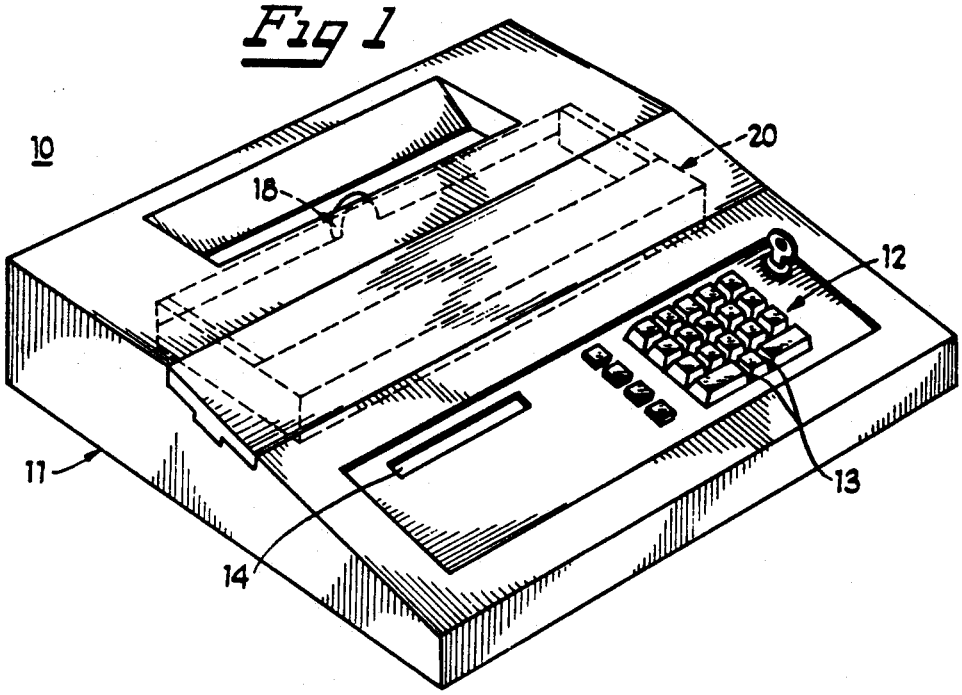
FIG. 1 is a perspective view of a check protector apparatus incorporating features of the present invention.
Figure 2:
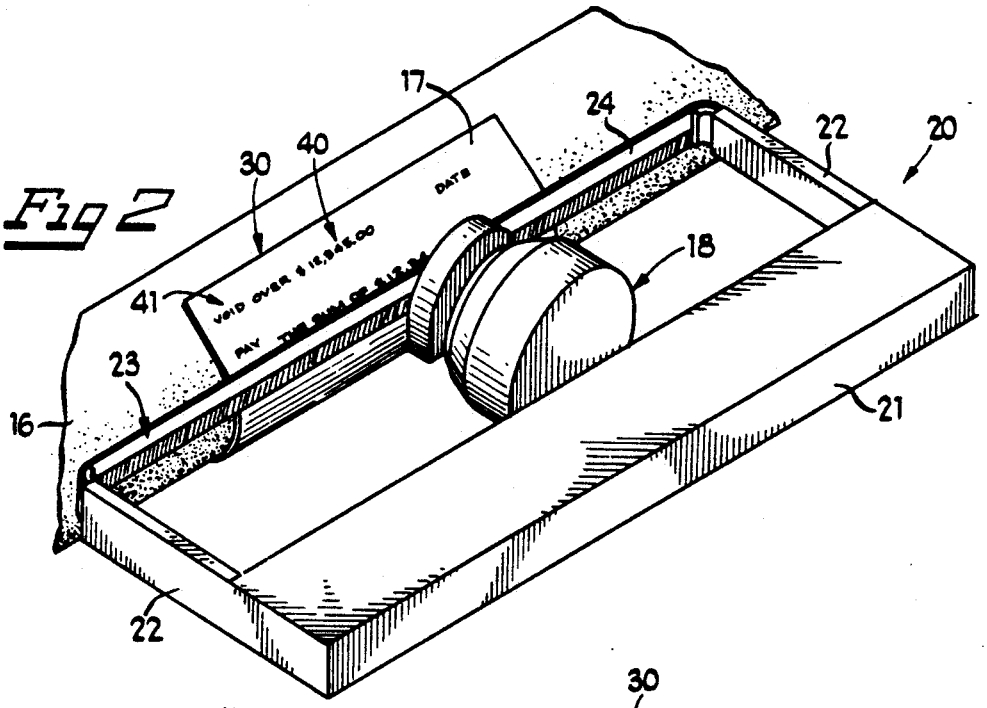
FIG. 2 is an enlarged, fragmentary, perspective view of the printing mechanism of the apparatus of FIG. 1 illustrated in the process of printing a check in accordance with the present invention.
Figure 4:
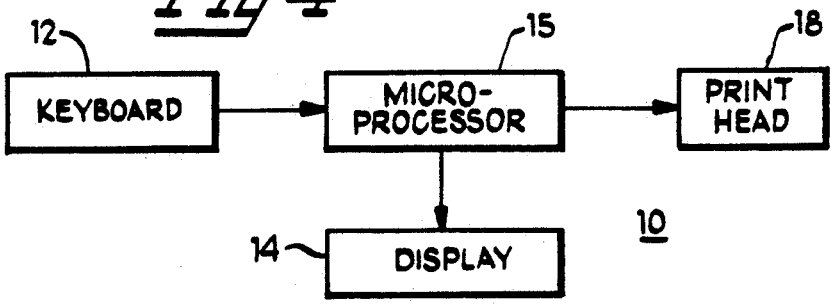
FIG. 4 is a functional block diagram of the apparatus of FIG. 1.

Referring to FIGS. 1, 2 and 4, there is illustrated a check protector, generally designated by the numeral 10, which has a cabinet 11 carrying an input keyboard 12 made up of a number of keys 13, and including a display 14, which may be a liquid crystal display. The check protector 10 includes a microprocessor 15 (See FIG. 4) which is coupled to the keyboard 12 and to the display 14 and responds to input from the keyboard 12 for changing the information displayed on the display 14. The check protector 10 also includes a platen 16 for carrying a medium 17 on which information is to be imprinted. The check protector 10 also includes a print head 18 which is on a carriage (not shown) reciprocatively movable in a direction parallel to the axis of the platen 16 in a known manner.

Referring in particular to FIG. 2, the check protector 10 also includes means (not shown) for mounting a ribbon cassette 20 having a housing 21 and two arms 22 projecting forwardly therefrom. In the housing 21 is a ribbon 23 which extends through the arms 22. The ribbon 23 moves forwardly through one of the arms 22 and is taken up through the other arm 22, defining a reach 24 between the distal ends of the arms 22 which is disposed alongside and parallel to the platen 16. This reach 24 of the ribbon 23 is disposed between the platen 16 and the print head 18 and is responsive to impacts of print wires (not shown) of the print head 18 for imprinting indicia on the medium 17, all in a known manner. The print head 18 and the ribbon cassette 20 may be of the type disclosed in the aforementioned co-pending U.S. application Ser. No. 588,452, the disclosure of which is incorporated herein by reference. Referring to FIG. 4, it can be seen that the print head 18 is coupled to the microprocessor 15 and is controlled thereby in response to the input data from the keyboard 12.

Figure 3:
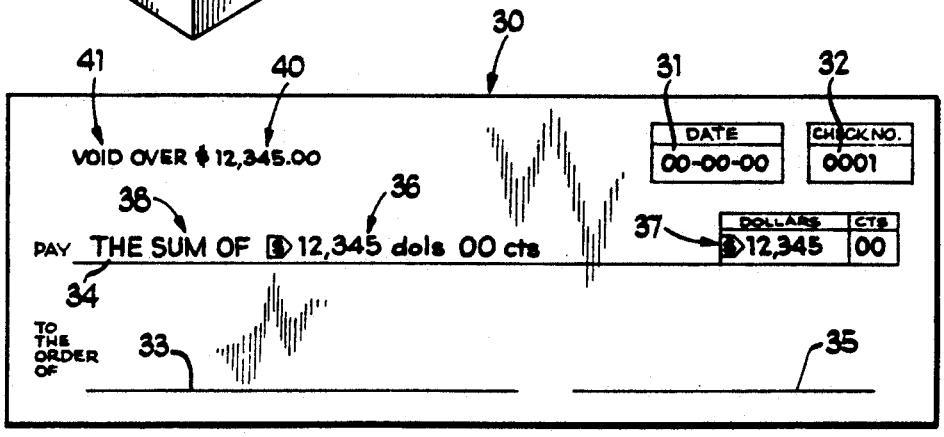
FIG. 3 is an enlarged plan view of the check illustrated in FIG. 2.
Figure 5:
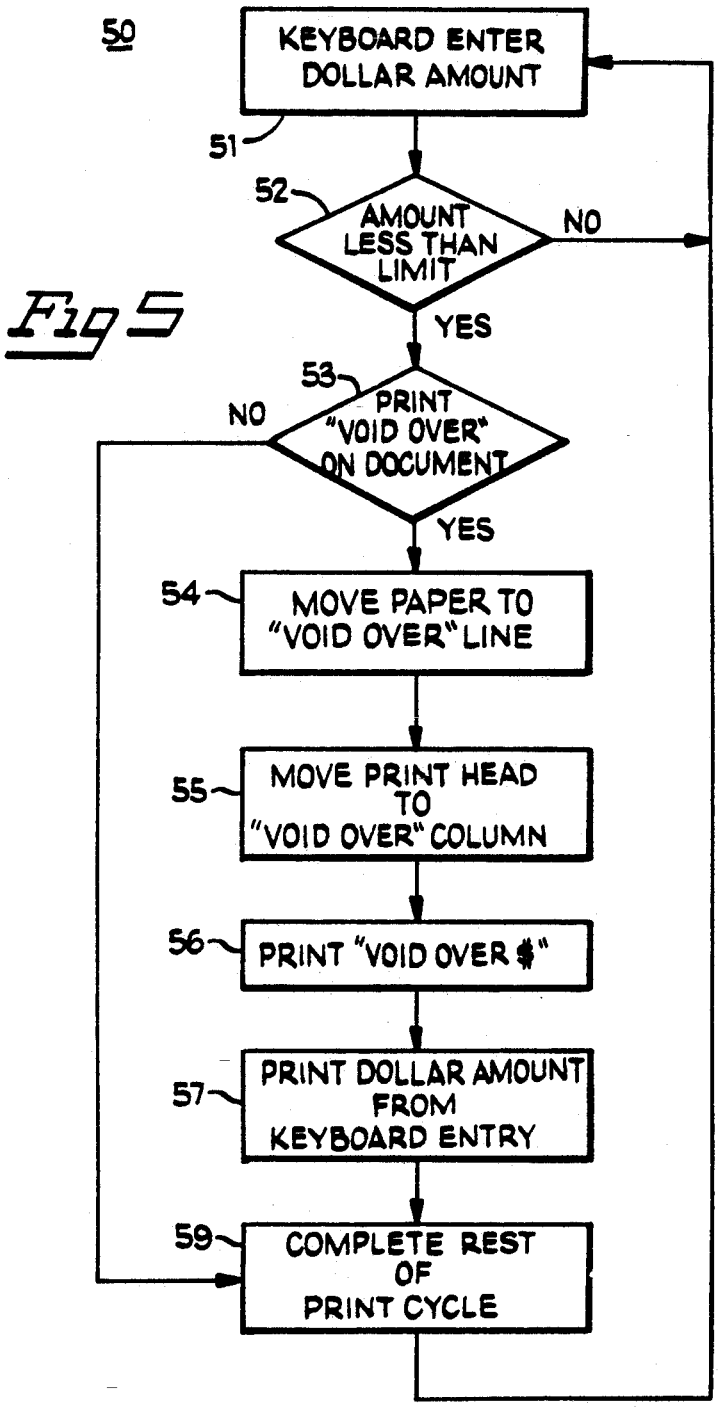
FIG. 5 is a flow chart illustrating the program for controlling the microprocessor of the apparatus of FIG. 4.

The medium 17 illustrated in FIG. 2 is in the form of a check 30, but it will be appreciated that the principles of the present invention are applicable to any type of financial instrument. Referring also to FIG. 3, the check 30 has the usual date line 31 and check number line 32 on which may be imprinted the current date and check number. Check 30 also includes the standard payee line 33 and amount line 34, as well as a signature line 35. The information on all of these lines may be imprinted by the check protector 10, in a known manner. It can be seen that the amount may be imprinted twice on the amount line 34, once in a pattern 36 of alphanumeric characters including both numerical digits and letters and, optionally, in a pattern of characters 37 which includes only numerical digits. Also, a predetermined standard message 38, such as "THE SUM OF" or the name of the disbursing bank may be inserted on the amount line 34 ahead of the amount, in a known manner. In this regard, it will be appreciated that the operator uses the keyboard 12 to enter the predetermined amount to be printed, and the microprocessor 15 responds to control the print head 18 to print the standard message 38 followed by pattern 36 of characters and, if desired, pattern 37 on the amount line 34, all in a known manner.

A fundamental aspect of the present invention is that, in addition to printing the amount in the character patterns 36 and 37 on the amount line 34, the check protector 10 also responds to the inputting of the predetermined amount from the keyboard 12 to print the predetermined amount in another pattern 40 of characters, preferably made up only of numerical digits, and in a location discrete and spaced from the amount line 34 which can be programmed by the user. The amount character pattern 40 is immediately preceded by an intelligible message 41, typically in alphabetical characters, indicating that the predetermined amount set forth in the pattern 40 is the maximum amount for which the instrument is valid. Thus, for example, the message 41 may be the words "VOID OVER" or "NOT VALID OVER". Preferably, the message 41 and the character pattern 40 are imprinted in smaller size characters than the character pattern 36, although it will be appreciated that any desired size could be utilized. Preferably, the message 41 is disposed immediately adjacent to the amount of character pattern 40, with no space therebetween, so as to prevent the insertion of additional numerical digits. It will be appreciated that, because of the presence of the message 41 and the fact that the predetermined amount is imprinted more than once on the check 30, a person attempting to alter the amount would have to alter it each of the times that it is imprinted, making the alteration much more difficult and time consuming and, thereby, significantly reducing the chances of an attempted alteration.

Referring to FIG. 4, there is illustrated a flow chart for a program 50 which controls the operation of the microprocessor 15. In a typical operation, when the user enters the predetermined amount on the keyboard 12 at block 51, the program proceeds to decision 52 to determine if that amount is less than some predetermined limit which may be preset by the operator. In other words, the check protector 10 may be set up to limit the amount for which the check can be imprinted. If the predetermined amount exceeds this limit, the program returns to block 51 and may display on the display 14 a suitable message indicating that the amount of the check has exceeded the limit. If the limit is not exceeded, the program drops to decision 53 to determine if the "VOID OVER" message 41 is to be imprinted on the check. Again, the operator may preset the check protector 10 to either use, or not use, the "VOID OVER" feature, as desired. If it is to be used, the program drops to block 54, and causes the paper medium 17 to be indexed to the "VOID OVER" line, and then proceeds to block 55 to move the print head 18 to the "VOID OVER" column. The program then drops to block 56 and causes the print head 18 to print the message 41 followed by the dollar sign (e.g., "VOID OVER $"), and then drops to block 57 to cause the print head 18 to immediately thereafter print the dollar amount which had been entered from the keyboard 13. The program then drops to block 59 and completes the rest of the print cycle, i.e., the printing of the date, check number, the amount on the amount line 34, and the payee 33 and, if desired, the signature. The program then returns to block 51. If, at decision 53, the check protector 10 was not to print the "VOID OVER" message, the program would drop immediately to block 59 and bypass the "VOID OVER" steps.

From the foregoing, it can be seen that there has been provided an improved secure financial instrument and method and apparatus for printing same, which protects against unauthorized increasing of the amount imprinted on the financial instrument.

We claim:

1. A method of printing on a medium images indicating an amount which are difficult to alter or forge, said method comprising the steps of: predetermining the amount to be printed, mechanically imprinting the predetermined amount on the medium more than once, respectively in separate patterns of characters, and mechanically imprinting immediately adjacent to one of the patterns an intelligible message relating to the predetermined amount.

2. The method of claim 1, wherein said step of imprinting the predetermined amount includes the step of imprinting the two patterns of characters respectively in different sizes.

3. The method of claim 1, wherein said step of imprinting the predetermined amount includes the step of imprinting numerical digits in each of the patterns.

4. The method of claim 1, wherein said step of imprinting an intelligible message includes the step of imprinting a message which indicates that the predetermined amount is a maximum amount.

* * * * *